US005607342A

United States Patent [19]

Evdokimenko et al.

[11] Patent Number: 5,607,342

[45] Date of Patent: Mar. 4, 1997

[54] HIGH VELOCITY FLAME JET APPARATUS FOR THERMOABRASIVE CUTTING OR CLEANING OR FOR THE APPLICATION OF PROTECTIVE COATINGS

[75] Inventors: Yuri Evdokimenko, Kiev, Ukraine; Ernest Kadyrov, Madison, Wis.; Valery Kadyrov, Kiev, Ukraine; Gennady Frolov, Kiev, Ukraine; Vladislav Kisel, Kiev, Ukraine

[73] Assignee: Demeton USA, Inc., Garden City Park, N.Y.

[21] Appl. No.: 410,787

[22] Filed: Mar. 27, 1995

[51] Int. Cl.[6] ..... B24C 5/02

[52] U.S. Cl. ..... 451/75; 451/102; 451/91

[58] Field of Search ..... 451/102, 101, 451/75, 38, 39, 40, 91; 239/79, 85; 431/158; 175/14

[56] References Cited

U.S. PATENT DOCUMENTS

| | | | |
|---|---|---|---|
| 2,714,563 | 8/1955 | Poorman et al. | 451/101 |
| 2,990,653 | 7/1961 | Browning | 451/102 |
| 3,854,997 | 12/1974 | Peck et al. | 451/102 |
| 4,384,434 | 5/1983 | Browning | 451/75 |

FOREIGN PATENT DOCUMENTS

| | | | |
|---|---|---|---|
| 0423619 | 4/1974 | U.S.S.R. | 451/102 |
| 0614725 | 12/1948 | United Kingdom | 451/102 |

*Primary Examiner*—Robert A. Rose

*Attorney, Agent, or Firm*—Galgano & Burke

[57] ABSTRACT

A the high velocity flame jet apparatus includes a supersonic gun having a main combustion chamber having two parts, one of which is air cooled and the other of which is water cooled. The air cooled portion of the chamber is provided with radial air inlet holes to allow the cooling air to enter the chamber and stabilize combustion. The water cooled portion of the chamber is elongated and terminates in a bend. A powder sprayer is arranged axially in the bent end of the combustion chamber and a removable exit nozzle is coupled to the distal end of the combustion chamber. Different removable nozzles are used for abrasive treatment and coating treatment. The first portion of the combustion chamber is provided with an ignition device coupling for coupling to a removable igniter. The removable igniter is coupled to fuel and oxygen sources and supplies the ignition temperature to the combustion chamber when the apparatus is started. After the gun is ignited, the igniter is removed. Air, water, fuel, and powder are supplied to the gun through conduits which are preferably bundled in an outer sheath and the air conduit is preferably provided with a "dead man" trigger switch so that the gun stops functioning when the trigger is released.

19 Claims, 7 Drawing Sheets

HIGH VELOCITY FLAME JET APPARATUS FOR THERMOABRASIVE CUTTING OR CLEANING OR FOR THE APPLICATION OF PROTECTIVE COATINGS

BACKGROUND OF THE INVENTION

1. Field of the Invention

The invention relates to a high velocity flame jet apparatus. More particularly, the invention relates to a high velocity flame jet burner for thermoabrasive cutting or cleaning or for applying protective coatings.

2. State of the Art

High velocity flame jet apparatuses are used for blast cleaning, abrasive cutting of rock and other solids, and for the atomization of liquids. These devices generally include a combustion chamber in which a combustible fluid such as kerosene is ignited, conduits for delivering air, combustible fluid, and particles to the combustion chamber, and an outlet nozzle through which particles exit at supersonic speed. The particles may be abrasive particles for cleaning or cutting or powder particles for protective coating.

High velocity flame jet apparatuses are used for cutting concrete, stone, steel, aluminum and other hard materials. They are also used for cleaning highways, runways, and various construction materials to remove organic deposits, corrosion and paint. In addition, these apparatuses are used to apply protective coatings of various materials to large surfaces. High velocity flame jet apparatuses are also often used under water.

A typical high velocity flame-jet apparatus is shown in U.S. Pat. No. 4,384,434 to Browning. Browning teaches an apparatus in which compressed air and abrasive particles are delivered through a single conduit to a "sand separator". The sand separator directs the abrasive particles into the combustion chamber and channels the air into an annular space around the combustion chamber and into the combustion chamber downstream of the particles. As the compressed air flows through the annular space it is heated to a temperature which will vaporize liquid fuel which is injected into the combustion chamber upstream of the air inlet. Browning's device has the advantage that air and abrasive particles may be conducted to the combustion chamber via a single conduit. However, in order to make effective use of the sand separator, the particles must be relatively large. This often requires sifting the particles before using them in the apparatus. In addition, the Browning ignition system requires that the combustion chamber be fitted with an oxygen conduit. One of Browning's embodiments injects combustible products in a direction perpendicular to the gas flow. This reduces the axial speed of the particles and produces extra wear on the apparatus. If the particles are protective coating, however, this arrangement results in the unnecessary coating of the inside of the apparatus reducing its useful lifespan. Moreover, Browning's arrangement results in the particles being heated in the combustion chamber which can reduce their hardness and thus their abrasive properties.

SUMMARY OF THE INVENTION

It is therefore an object of the invention to provide a high velocity flame jet apparatus which is useful for both thermoabrasive and protective treatments.

It is also an object of the invention to provide a high velocity flame jet apparatus which operates effectively with particles of different sizes.

It is another object of the invention to provide a high velocity flame jet apparatus which does not require coupling to an oxygen conduit during operation.

It is still another object of the invention to provide a high velocity flame jet apparatus in which combustion products are injected axially into the combustion chamber.

It is yet another object of the invention to provide a high velocity flame jet apparatus in which abrasive particles are not overheated.

In accord with these objects which will be discussed in detail below, the high velocity flame jet apparatus of the present invention includes a supersonic gun having a main combustion chamber having two parts, one of which is air cooled and the other of which is water cooled. The air cooled portion of the chamber is provided with radial air inlet holes to allow the cooling air to enter the chamber and stabilize combustion. The water cooled portion of the chamber is elongated and terminates in a bend. A powder sprayer is arranged axially in the bent end of the combustion chamber and a removable exit nozzle is coupled to the distal end of the combustion chamber. Different removable nozzles are used for abrasive treatment and coating treatment. Preferably, the exit nozzle has a conical shape which changes the direction of the gas flow to suck abrasive powder out of the gun. The first portion of the combustion chamber is provided with an ignition device coupling for coupling to a removable igniter. The removable igniter is coupled to fuel and oxygen sources and supplies the ignition temperature to the combustion chamber when the apparatus is started. After the apparatus is started, the igniter is removed. Air, water, fuel, and powder are supplied to the apparatus through conduits which are preferably bundled in an outer sheath and the air conduit is preferably provided with a "dead man" trigger switch so that the apparatus stops functioning when the trigger is released. Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
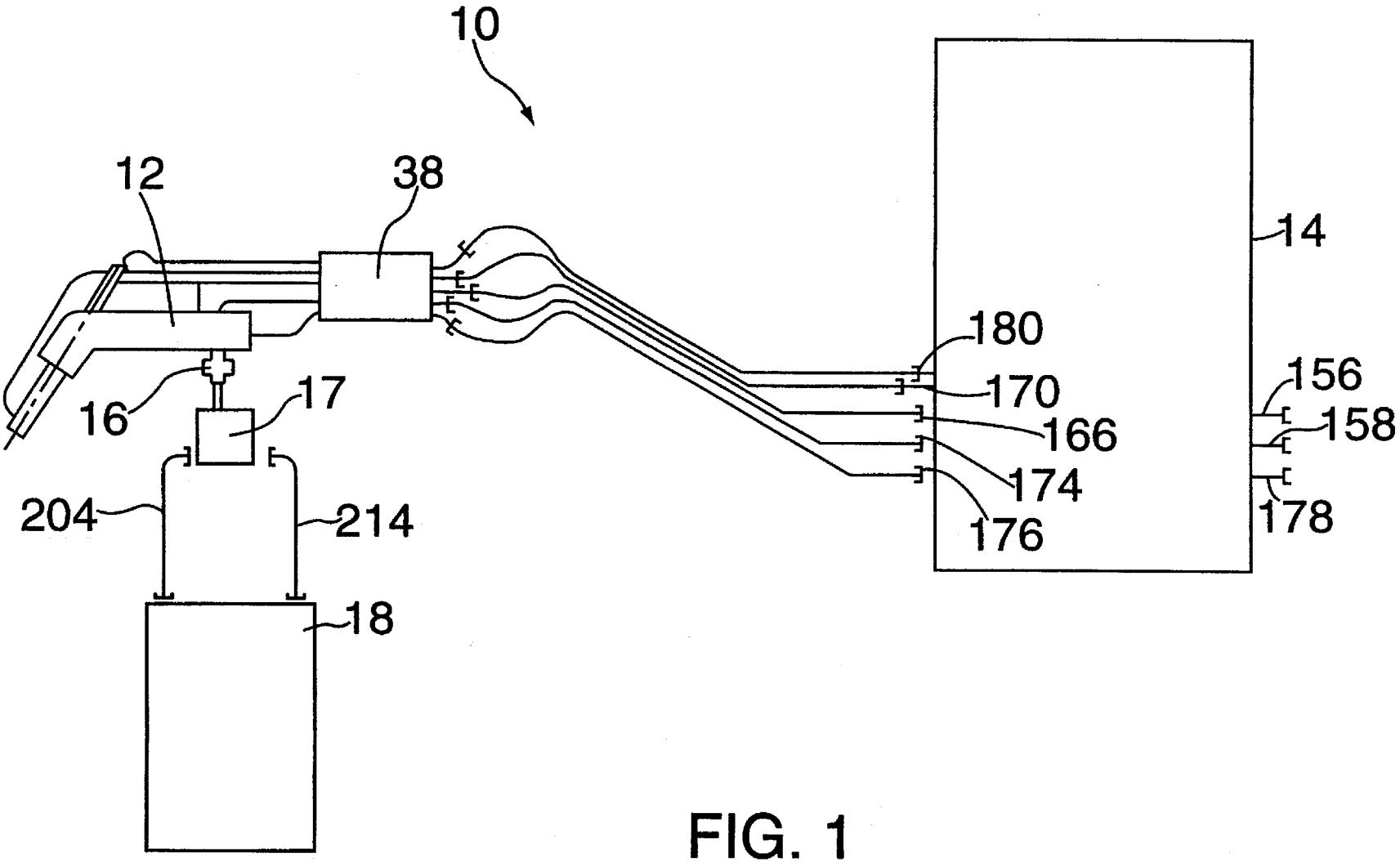
FIG. 1 is a schematic diagram of the main components of the apparatus according to the invention.

FIG. 1 shows a schematic diagram of the basic components of the apparatus 10. These components include a supersonic gun 12, a gas and fuel supply 14, an ignition device coupling 16, a removable igniter 17, and an ignition supply 18.

Turning now to FIGS. 2 and 2*a*–2*c*, the supersonic gun 12 generally includes a combustion chamber 20, a mixing head 22, an output nozzle 24, an ignition channel 26, a number of supply tubes 28–36, and a handle 38.

The combustion chamber 20 has two parts 20*a* and 20*b*. The first part 20*a* of the combustion chamber 20 has an annular space 40 between inner wall 42 and outer wall 44. The annular space 40 acts as an air collector and is supplied with air from tube 30. Most of the air in the annular space 40 is used to cool the first part 20*a* of the combustion chamber and is injected into the mixing head 22. A smaller amount of the air in space 40 is injected through radial holes 46 into the first part 20*a* of the combustion chamber 20. The second part 20*b* of the combustion chamber 20 is elongated to ensure complete combustion and is provided with an annular water space 48 defined by inner and outer shells 50 and 52. The water space 48 receives water from the nozzle 24 as explained below and water exits from space 48 via a branch 32*a* of tube 32. The distal end of the second part 20*b* of the combustion chamber 20 has a bend and is provided with a flange 54 to accommodate powder sprayer 56.

The mixing head 22 has a body 58 containing a fuel nozzle 60 and a fuel filter 62. Fuel-air mixers 64, 66 are located downstream of the fuel nozzle 60 in the mixing head 22 and are provided with narrow ducts (shown in dotted lines in FIG. 2) which are about 2 mm in diameter. After passing through these ducts, the fuel forms small droplets which are easily ignited. The mixing head is preferably coupled to the first part 20*a* of the combustion chamber 20 by a nut 68. Fuel is supplied to the mixing head via tube 28 and air is supplied via tube 30.

Figure 2:
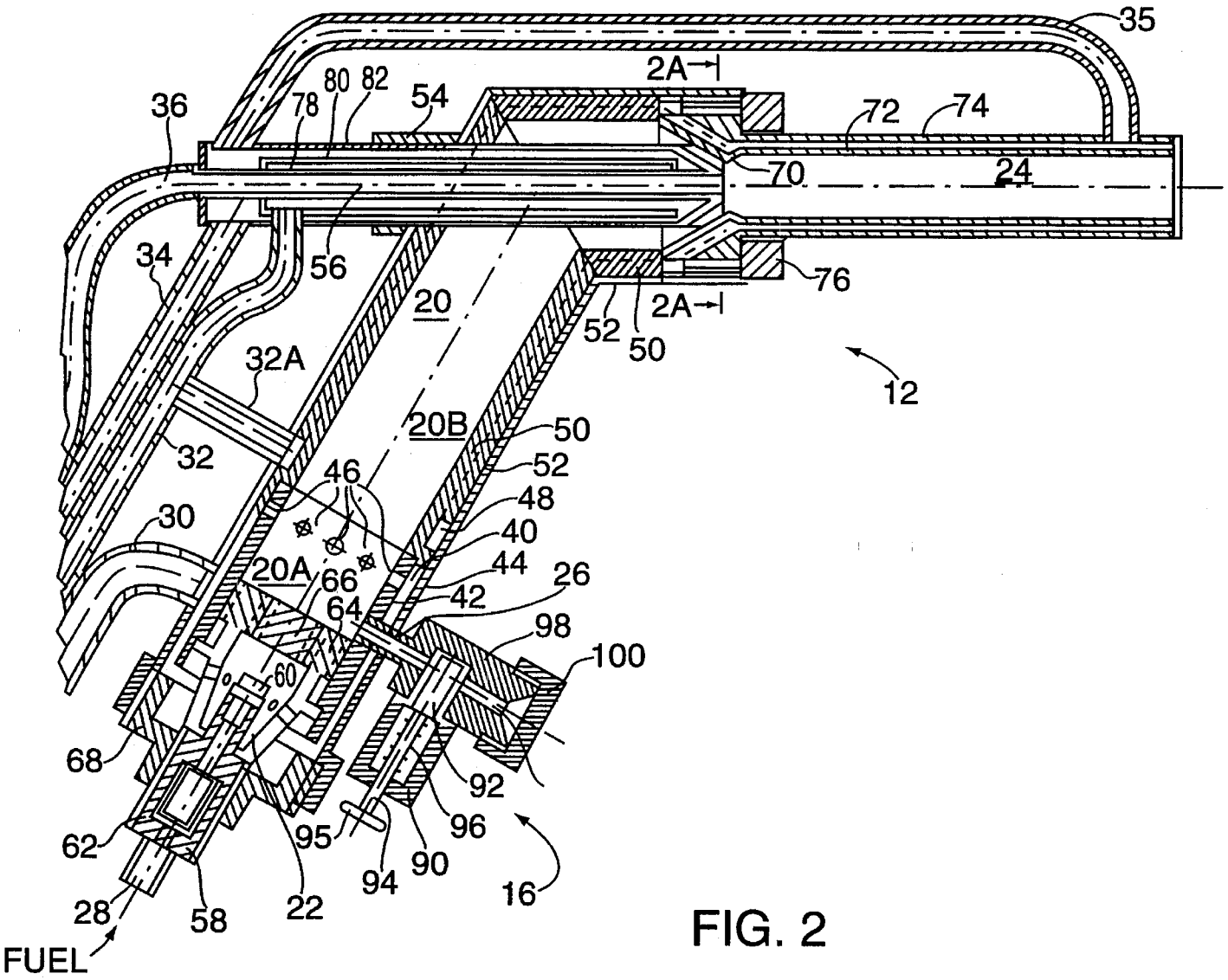
FIG. 2 is an enlarged longitudinal sectional view of the supersonic gun portion of the apparatus.
Figure 2A:
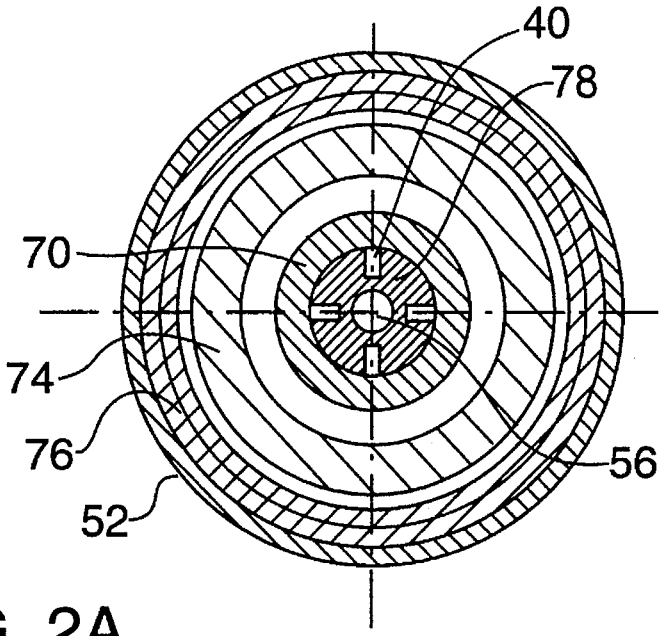
FIG. 2*a* is an enlarged section taken along line 2A—2A of FIG. 2.
Figure 2B:
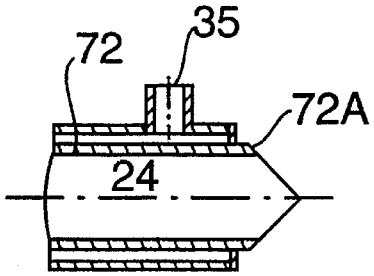
FIG. 2*b* is a broken sectional view of an alternate embodiment of the cylindrical accelerating channel of the supersonic gun.

The output nozzle 24 includes a Laval nozzle 70 having narrow entru and a diverging exit which is used to create a supersonic flow, a cylindrical accelerating channel 72, and an external shell 74. The external shell 74 of the output nozzle 24 is preferably coupled to the combustion chamber by a nut 76. The annular space between the external shell 74 and the accelerating channel 72 is fed with cooling water by tube 35 which receives water from tube 34 as described below. As mentioned above, the annular water space 48 in the second part 20*b* of the combustion chamber 20 is also in fluid communication with the annular space between shell 74 and channel 72. When spraying protective coatings, the distal end of the accelerating channel 72 is preferably provided with a double angled cut 72*a*, as shown in FIG. 2*b*, which causes the output of the channel to spread in a V shaped spray.

The powder sprayer 56 includes three concentric cylindrical parts 78, 80, and 82, The innermost part 78 is coupled to tube 36 which supplies abrasive material or coating powder for spraying. The outer two parts 80, 82 form a cooling chamber which receives water from tube 34. Water exits the cooling chamber through tubes 32 and 35.

Figure 2C:
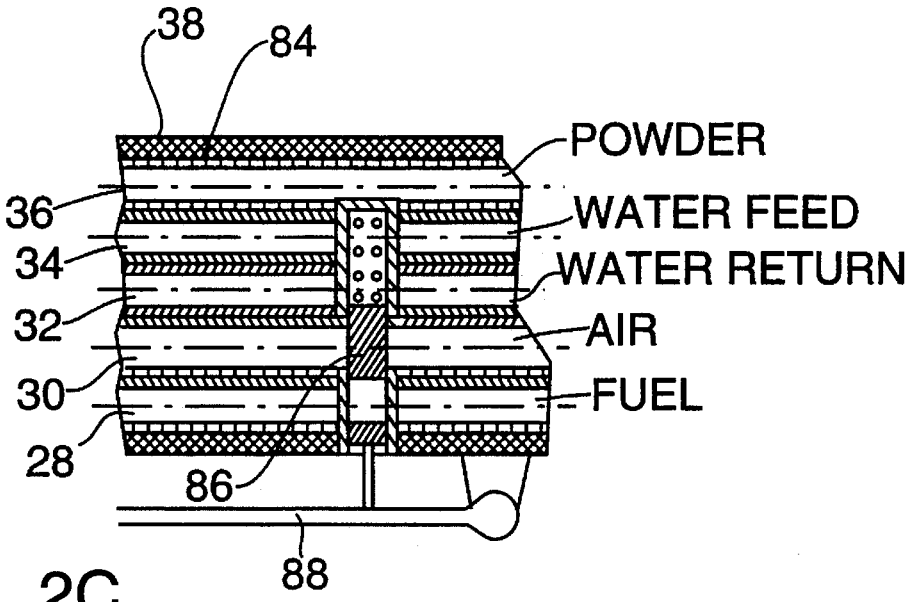
FIG. 2*c* is a broken sectional view of bundled supply conduits with an emergency shut off valve.

The tubes 28–36 are preferably enclosed in an outer sheath 84, shown in FIG. 2*c* which is formed as part of the handle 38. The air supply tube 30 is preferably provided with an emergency valve 86 which is coupled to a trigger 88 in the handle. The emergency valve 86 acts like a "dead man switch" to automatically block the flow of air through the tube 30 when an operator releases the trigger 88. When the flow of air is blocked, the apparatus ceases to function.

The ignition device coupling 16 includes a valve body 90, a valve member 92, a valve stem 94 with an exterior handle 95, and a biasing spring 96. The valve body 90 is coupled to socket which includes the ignition channel 26 and is covered by a lid 100 when it is not coupled to the igniter 17 which is described below. The valve member 92 is biased into the socket 98 by the spring 96 so that the ignition channel 26 is blocked. The channel is unblocked by pulling on the handle 95.

Figure 3:
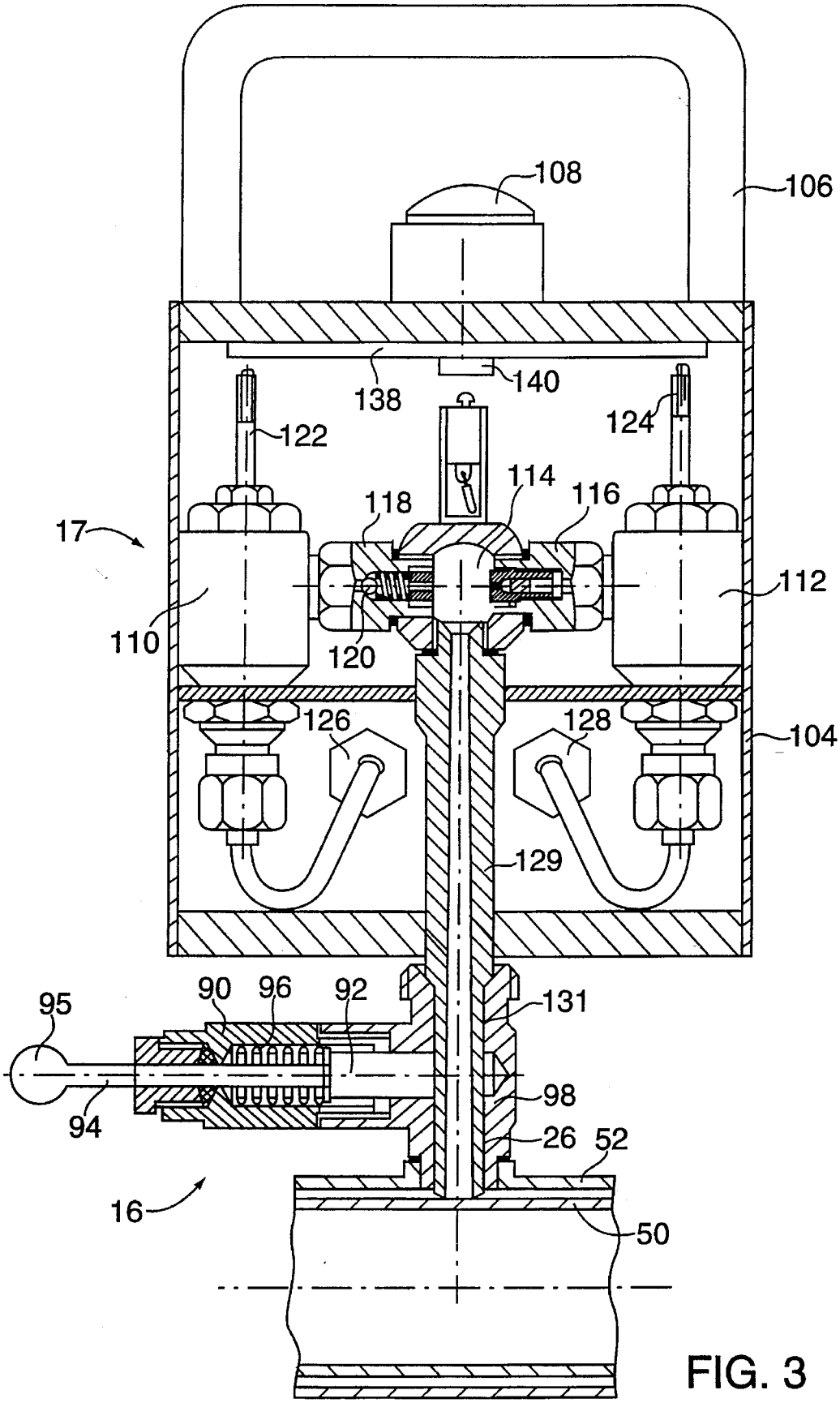
FIG. 3 is an enlarged longitudinal sectional view of the removable igniter.
Figure 4:
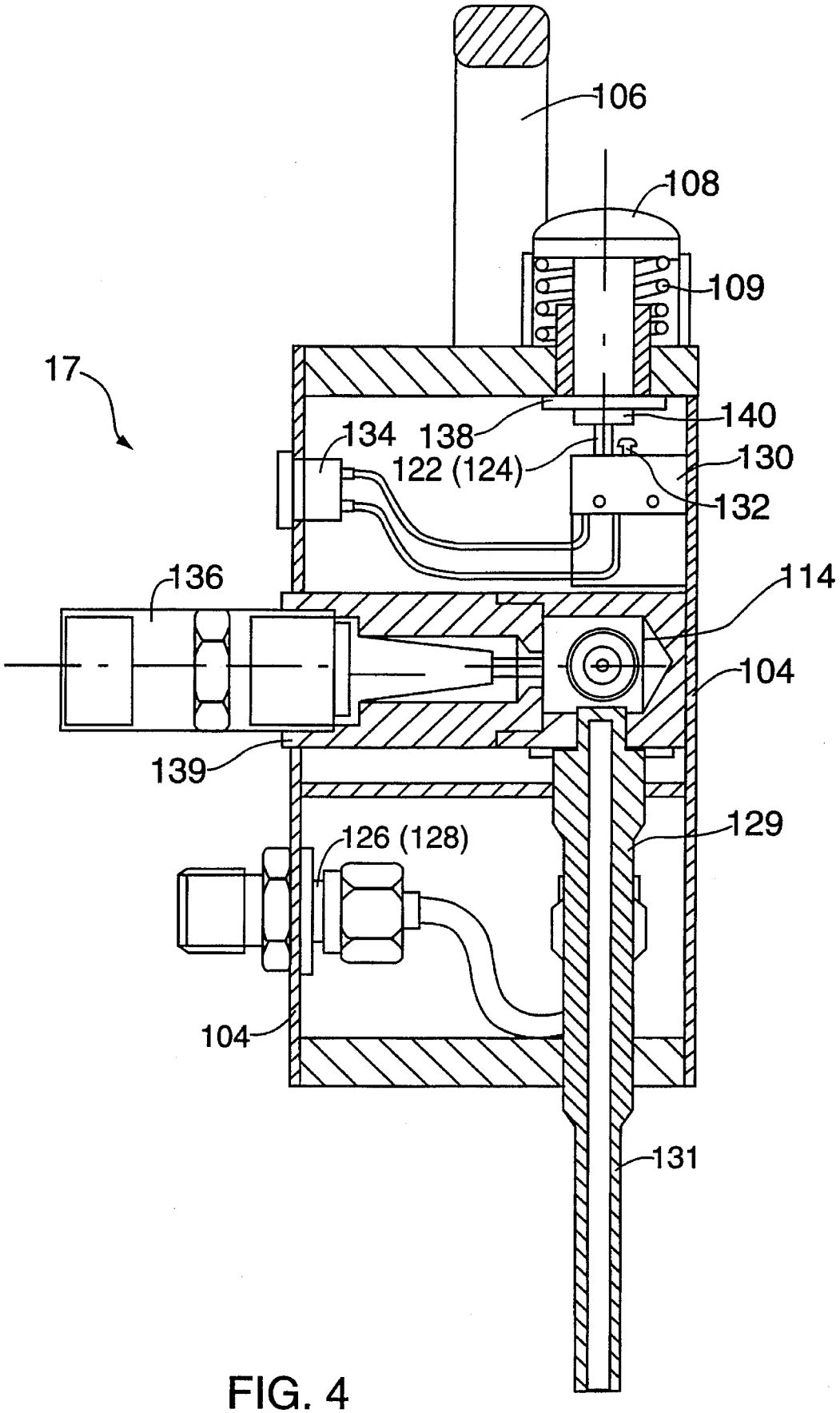
FIG. 4 is an enlarged transverse sectional view of the removable igniter of FIG. 3.

FIGS. 3 and 4 show details of an igniter 17 which is removably coupled to the socket 98 of the ignition device coupling 16. The igniter 17 includes a housing 104 with a handle 106 and a starting button 108 which is biased by a spring 109. A first starting valve 110 for air and a second starting valve 112 for fuel are mounted in the housing 104 and coupled to a micro combustion chamber 114. The fuel valve 112 has a fuel nozzle 116 for spraying fuel into the micro combustion chamber 114. The oxygen valve 110 has an oxygen nozzle 118 for spraying oxygen into the micro combustion chamber 114. The oxygen nozzle 118 is provided with an automatic backflow prevention utilizing a spring biased ball valve 120. Both of the starting valves are actuated by spring biased plungers 122, 124 and are provided with appropriate inlet couplings 126, 128 for coupling to fuel and oxygen supplies as described in detail below. An exit nozzle 129 is coupled to the micro combustion chamber 114 and has a distal end 131 which is dimensioned to fit into the socket 98 of the ignition device coupling 16. An electrical ignition switch 130 having an actuating button 132 is mounted above the micro combustion chamber 114 beneath the starting button 108. The switch 130 is coupled to an ignition coil (described below) via a socket connection 134 in the housing 104. A spark plug 136 is mounted in a spark chamber 139 which is coupled to the micro combustion chamber 114. The spark plug is powered by a conventional ignition coil which is coupled to the spark plug by means of the pushbutton 108. The spring biased starting button 108 is coupled to a starting plate 138 having a central extension 140. When the button 108 is pressed against the spring 109, the starting plate 138 engages the plungers 122, 124 of the valves 110, 112 and the central extension 140 engages the actuating button 132 of the switch 130.

The supersonic gun described above is preferably made of stainless steel and other suitable materials as will be appreciated by those skilled in the art.

Figure 5:
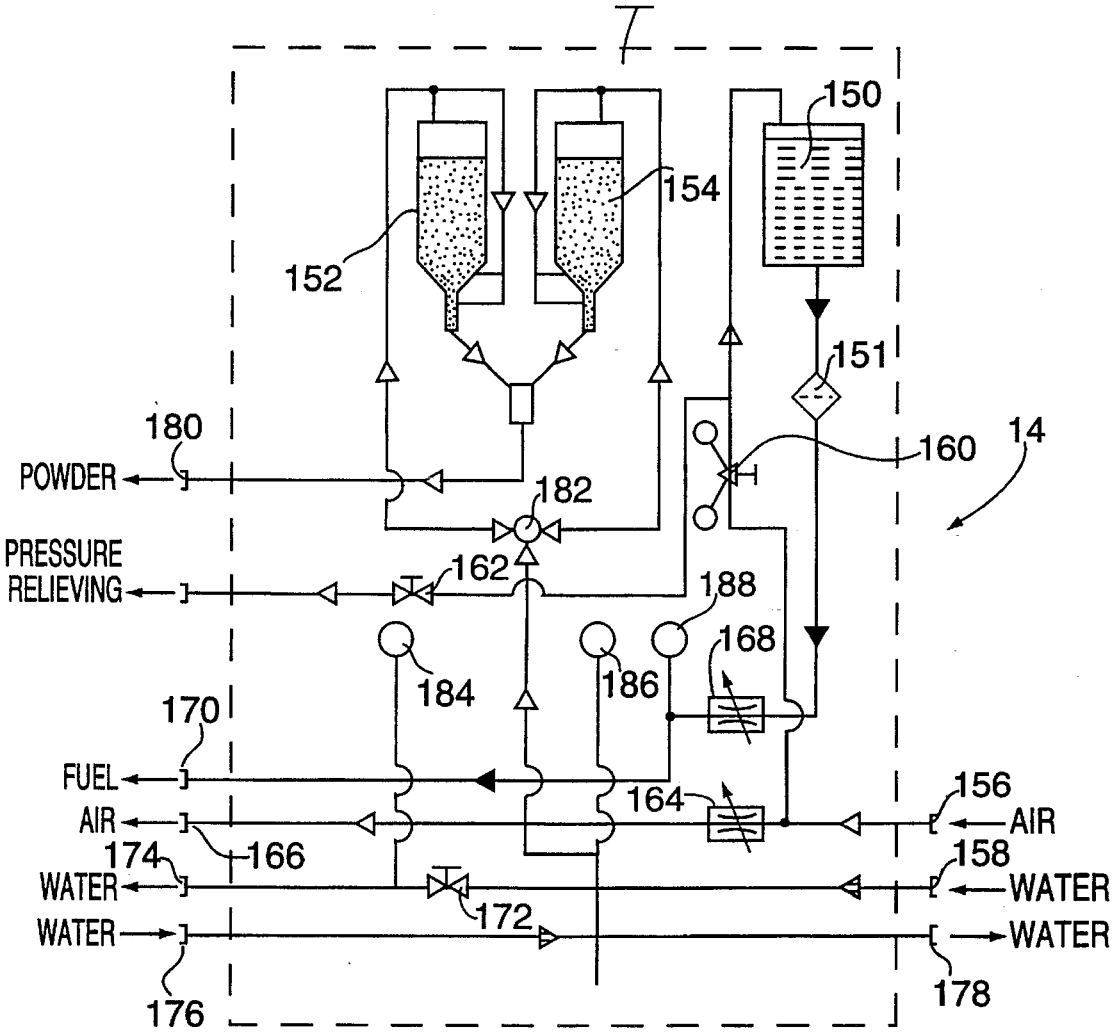
FIG. 5 is a schematic diagram of the gas and fuel supply device.

Turning now to FIG. 5, the gas and fuel supply 14 includes fuel tank 150 and a pair of powder tanks 152, 154. Inlets 156 and 158 are provided for pressurized air and water respectively. Pressurized air is coupled through an adjustable pressure valve 160 to the fuel tank 150 and through a relief valve 162 to the atmosphere. Pressurized air is also supplied via an adjustable valve 164 to an output coupling 166 for coupling to the supersonic gun 12 described above and to the powder tanks 152, 154 as described below. Pressurized fuel is fed through a filter 151 and an adjustable valve 168 to an output coupling 170 for coupling to the supersonic gun 12. Cooling water is fed via an adjustable valve 172 to an output coupling 174 for coupling to the supersonic gun 12 and water returning from the gun is received by a water inlet 176 and fed out of the supply unit 14 through a coupling 178. Powder is supplied from the tanks 152, 154 to the gun 12 through an output coupling 180. A valve 182 supplies air to pressurize the powder tanks. Pressure gauges 184, 186, and 188 monitor the pressure of the water, air, and fuel respectively. The triangles in FIG. 5 indicate the direction of flow of materials.

Figure 6:
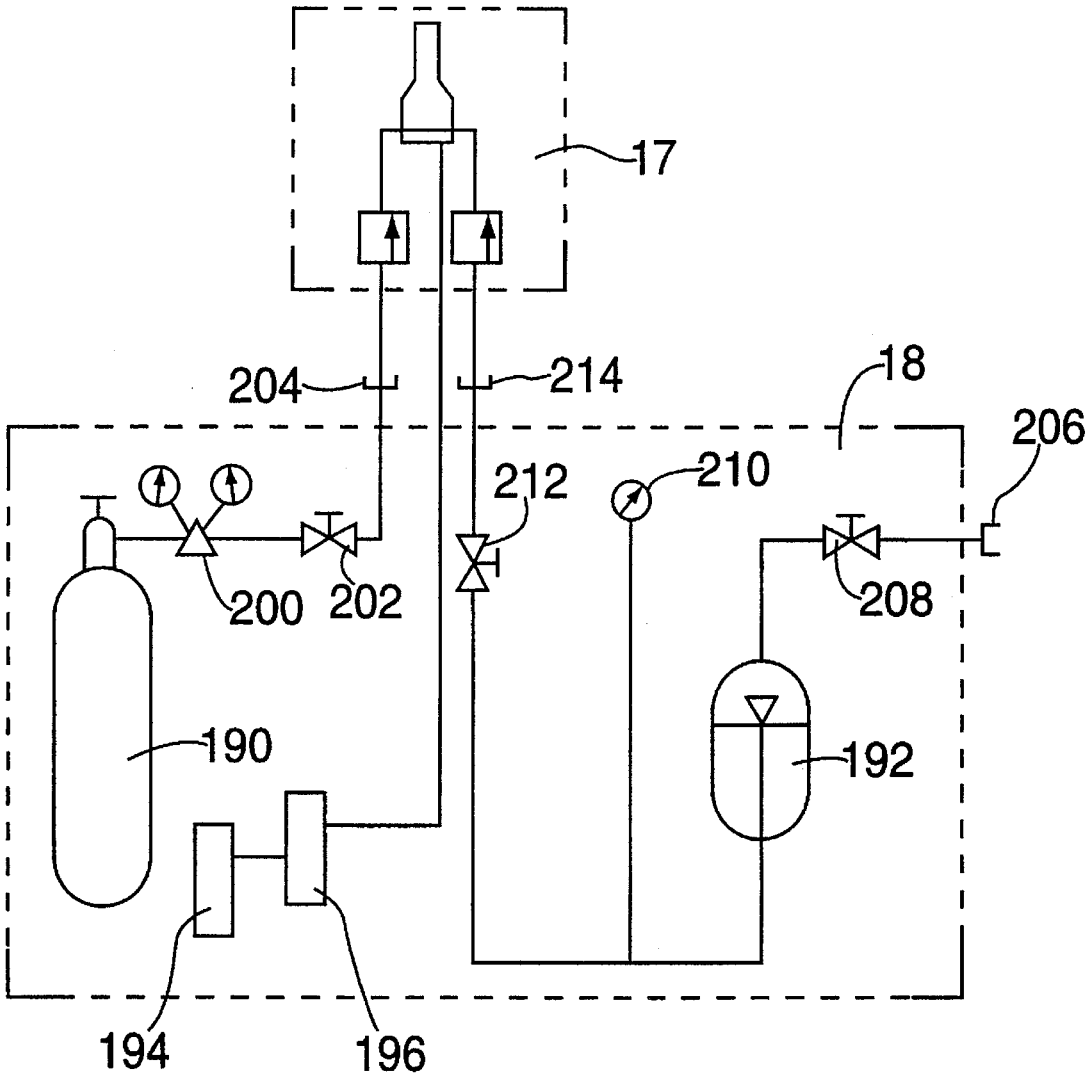
FIG. 6 is a schematic diagram of the ignition supply device.

FIG. 6 shows the details of the ignition supply 18. The ignition supply 18 generally includes an oxygen tank 190, a fuel tank 192, a power source 194 and an ignition coil 196.

The oxygen tank 190 is coupled via a pressure reducer 200 and a stop valve 202 to a coupling 204 for coupling to the igniter 17 described above. The fuel tank 192 is pressurized from an external source of pressure which is coupled to the tank 192 via a coupling 206 and a valve 208. The pressure of the fuel is monitored by a gauge 210. Pressurized fuel is coupled to the igniter 17 through a valve 212 and a coupling 214.

The couplings described above for connecting the gas-fuel supply 14 to the gun 12 and the ignition supply 18 to the igniter 17 are fitted with hoses and/or other conduits as shown schematically for example in FIG. 1. The fuel tanks 150 and 192 are filled with kerosene or other suitable fuel and the powder tanks 152, 154 are filled with abrasive or coating powders.

The apparatus operates as follows: all of the valves and switches are turned off and the gun 12 is fitted with the igniter 17 and the supplies 14 and 18 are coupled to the gun and the igniter. Before operating the gun, the water supply is turned on and an adequate cooling water pressure is set by the valve 172 and indicated by gauge 184. An external supply of pressurized air is coupled to the coupling 156 and the pressure in the fuel tank 150 is set by valves 160 and 162 and indicated by gauge 186. Pressure in the fuel tank 192 is set by valve 208 and indicated by gauge 210. Oxygen pressure is set by valve 202 and regulated by reducer 200. The valves 164 and 168 are opened and the trigger 88 is pressed to allow fuel and air to enter the gun at the operation pressure indicated by gauges 186 and 188. The preferred operating pressure is in the range of 0.5–0.9 MPa. The igniter button 108 is then pressed and fuel and oxygen enter the micro combustion chamber 114. The spark plug 136 is also ignited when the button 108 is pressed. High temperature products of ignition in the micro combustion chamber 114 exit through the nozzle 131 and enter the combustion chamber 20 in the gun 12 and ignite the fuel and air mixture in the chamber 20. At this point, the igniter 17 is removed from the gun 12. The air and fuel pressures are adjusted by the valves 164, 168 and valve 182 is opened to allow powder to enter the gun. The gun operates as long as the operator holds the trigger 88.

There have been described and illustrated herein a high velocity flame jet apparatus. While particular embodiments of the invention have been described, it is not intended that the invention be limited thereto, as it is intended that the invention be as broad in scope as the art will allow and that the specification be read likewise. Thus, the exact dimensions of the gun, the shape of the handle, the configuration of the ignition circuit, and the powder tank may vary without affecting the inventive aspects of the gun. It will therefore be appreciated by those skilled in the art that yet other modifications could be made to the provided invention without deviating from its spirit and scope as so claimed.

We claim:

1. A high velocity flame jet apparatus for particle spraying comprising:

a) a combustion chamber having a first upstream part and a second downstream part;

b) a fuel mixing chamber coupled to said first upstream part of said combustion chamber;

c) a fuel igniter coupled to said combustion chamber downstream of said fuel mixing chamber;

d) an output nozzle coupled to said second downstream part of said combustion chamber;

e) a powder sprayer coupled to said output nozzle for delivering particles to said output nozzle for spraying;

f) an air cooling chamber surrounding said first upstream part of said combustion chamber; and g) a first water cooling chamber surrounding said second downstream part of said combustion chamber, wherein fuel from said fuel mixing chamber is ignited by said igniter and accelerated in said combustion chamber, and particles from said powder sprayer are mixed with products of combustion from said combustion chamber in said output nozzle.

2. An apparatus according to claim 1, wherein:

said output nozzle is removable from said combustion chamber.

3. An apparatus according to claim 1, further comprising:

h) a second water cooling chamber surrounding said output nozzle, said second water cooling chamber being fluidly coupled to said first water cooling chamber.

4. An apparatus according to claim 1, further comprising:

h) a plurality of air conduits coupling said air cooling chamber with said combustion chamber such that air from said air cooling chamber enters said combustion chamber.

5. An apparatus according to claim 1, wherein:

said second downstream part of said combustion chamber is provided with a bend upstream of said output nozzle.

6. An apparatus according to claim 1, wherein:

said fuel mixing chamber is removable from said combustion chamber.

7. An apparatus according to claim 1, wherein:

said fuel igniter is removable from said combustion chamber.

8. A high velocity flame jet apparatus for particle spraying comprising:

a) a combustion chamber having a first upstream part and a second downstream part;

b) a fuel mixing chamber coupled to said first upstream part of said combustion chamber;

c) a fuel igniter coupled to said combustion chamber downstream of said fuel mixing chamber;

d) an output nozzle coupled to said second downstream part of said combustion chamber, said fuel igniter is removable from said combustion chamber, and a spring-biased valve coupling said fuel igniter to said combustion chamber such that said spring-biased valve automatically closes when said igniter is removed from said combustion chamber; and e) a powder sprayer coupled to said output nozzle for delivering particles to said output nozzle for spraying, wherein fuel from said fuel mixing chamber is ignited by said igniter and accelerated in said combustion chamber, and particles from said powder sprayer are mixed with products of combustion from said combustion chamber in said output nozzle.

9. An apparatus according to claim 1, wherein:

said powder sprayer has a frustroconical end, said output nozzle is coupled to said combustion chamber via a frustroconical passage, and said frustroconical end of said powder sprayer is disposed in said frustroconical passage.

10. A high velocity flame jet apparatus for particle spraying comprising:

a) a combustion chamber having a first upstream part and a second downstream part;

b) a fuel mixing chamber coupled to said first upstream part of said combustion chamber;

c) a fuel igniter coupled to said combustion chamber downstream of said fuel mixing chamber;

d) an output nozzle coupled to said second downstream part of said combustion chamber;

e) a powder sprayer coupled to said output nozzle for delivering particles to said output nozzle for spraying;

f) a handle, said handle including an air conduit for supplying oxygen to said combustion chamber; and g) a spring biased valve coupled to said air conduit and mounted in said handle such that said valve is open only when said handle is being grasped, wherein fuel from said fuel mixing chamber is ignited by said igniter and accelerated in said combustion chamber, and particles from said powder sprayer are mixed with products of combustion from said combustion chamber in said output nozzle.

11. An apparatus according to claim 9, wherein:

said output nozzle is removable from said combustion chamber and said frustroconical passage is part of said output nozzle.

12. A high velocity flame jet apparatus for particle spraying comprising:

a) a combustion chamber having a first upstream part and a second downstream part;

b) a fuel mixing chamber coupled to said first upstream part of said combustion chamber;

c) a fuel igniter coupled to said combustion chamber downstream of said fuel mixing chamber;

d) an output nozzle coupled to said second downstream part of said combustion chamber; and e) a powder sprayer for delivering particles to said output nozzle, wherein said second downstream part of said combustion chamber has a bend located upstream of said output nozzle.

13. An apparatus according to claim 12, further comprising:

f) an air cooling chamber surrounding said first upstream part of said combustion chamber; and g) a first water cooling chamber surrounding said second downstream part of said combustion chamber.

14. An apparatus according to claim 13, further comprising:

h) a second water cooling chamber surrounding said output nozzle, said second water cooling chamber being fluidly coupled to said first water cooling chamber.

15. An apparatus according to claim 13, further comprising:

h) a plurality of air conduits coupling said aid cooling chamber with said combustion chamber such that air from said air cooling chamber enters said combustion chamber.

16. An apparatus according to claim 12, wherein:

said fuel mixing chamber is removable from said combustion chamber.

17. An apparatus according to claim 12, wherein:

said fuel igniter is removable from said combustion chamber.

18. An apparatus according to claim 17, further comprising:

a spring-biased valve coupling said fuel igniter to said combustion chamber such that said spring-biased valve automatically closes when said igniter is removed from said combustion chamber.

19. An apparatus according to claim 12, wherein:

said output nozzle is removable from said combustion chamber.

* * * * *